US006173911B1

(12) United States Patent
Hui-Chen

(10) Patent No.: US 6,173,911 B1
(45) Date of Patent: Jan. 16, 2001

(54) FLOW CONTROL DEVICE OF PISTOL NOZZLE

(76) Inventor: Chao Hui-Chen, P.O. Box 453, Taichung (TW)

( * ) Notice: Under 35 U.S.C. 154(b), the term of this patent shall be extended for 0 days.

(21) Appl. No.: 09/377,710

(22) Filed: Aug. 20, 1999

(51) Int. Cl.[7] ..... B05B 7/02
(52) U.S. Cl. ..... 239/526
(58) Field of Search ..... 239/525, 526, 239/569, 583

(56) References Cited

U.S. PATENT DOCUMENTS 2,984,418 * 5/1961 Dickmann et al. ..... 239/526 X
4,915,304 * 4/1990 Campani ..... 239/526 X
5,662,273 * 9/1997 Chih ..... 239/526
5,806,770 * 9/1998 Wang ..... 239/526 X
5,967,421 * 10/1999 Wang ..... 239/526
5,967,422 * 10/1999 Wang ..... 239/526
6,007,003 * 12/1999 Wang ..... 239/526 X

* cited by examiner

*Primary Examiner*—Andres Kashnikow
*Assistant Examiner*—Steven J. Ganey
(74) *Attorney, Agent, or Firm*—Harrison & Egbert

(57) ABSTRACT

A water sprayer nozzle includes a barrel and a hand grip which is fastened at one end thereof with one end of the barrel and provided at other end thereof with a hose connector. The hand grip is provided therein with a water channel in communication with the barrel, and a receiving compartment in communication with the water channel. The hand grip is further provided with a water stopping member, an orientation push button, and a control push button for regulating the flow of water entering the water channel from the receiving compartment.

1 Claim, 5 Drawing Sheets

FLOW CONTROL DEVICE OF PISTOL NOZZLE

FIELD OF THE INVENTION

The present invention relates generally to a water sprayer nozzle, and more particularly to a flow control device of the water sprayer nozzle.

BACKGROUND OF THE INVENTION

The conventional water sprayer nozzle is provided with a control lever for controlling the flow of water. The control lever must be pressed continually with a hand so as to let the water out without interruption. The control lever is in fact primitive in design in view of the fact that it is very tiresome for a person to press continually the control lever with a hand.

SUMMARY OF THE INVENTION

The primary objective of the present invention is to provide a water sprayer nozzle with a flow control device capable of controlling the water flow with ease.

In keeping with the principle of the present invention, the foregoing objective of the present invention is attained by a nozzle handle which is provided with an orientation push button and a control push button for easy control of the flow of water.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
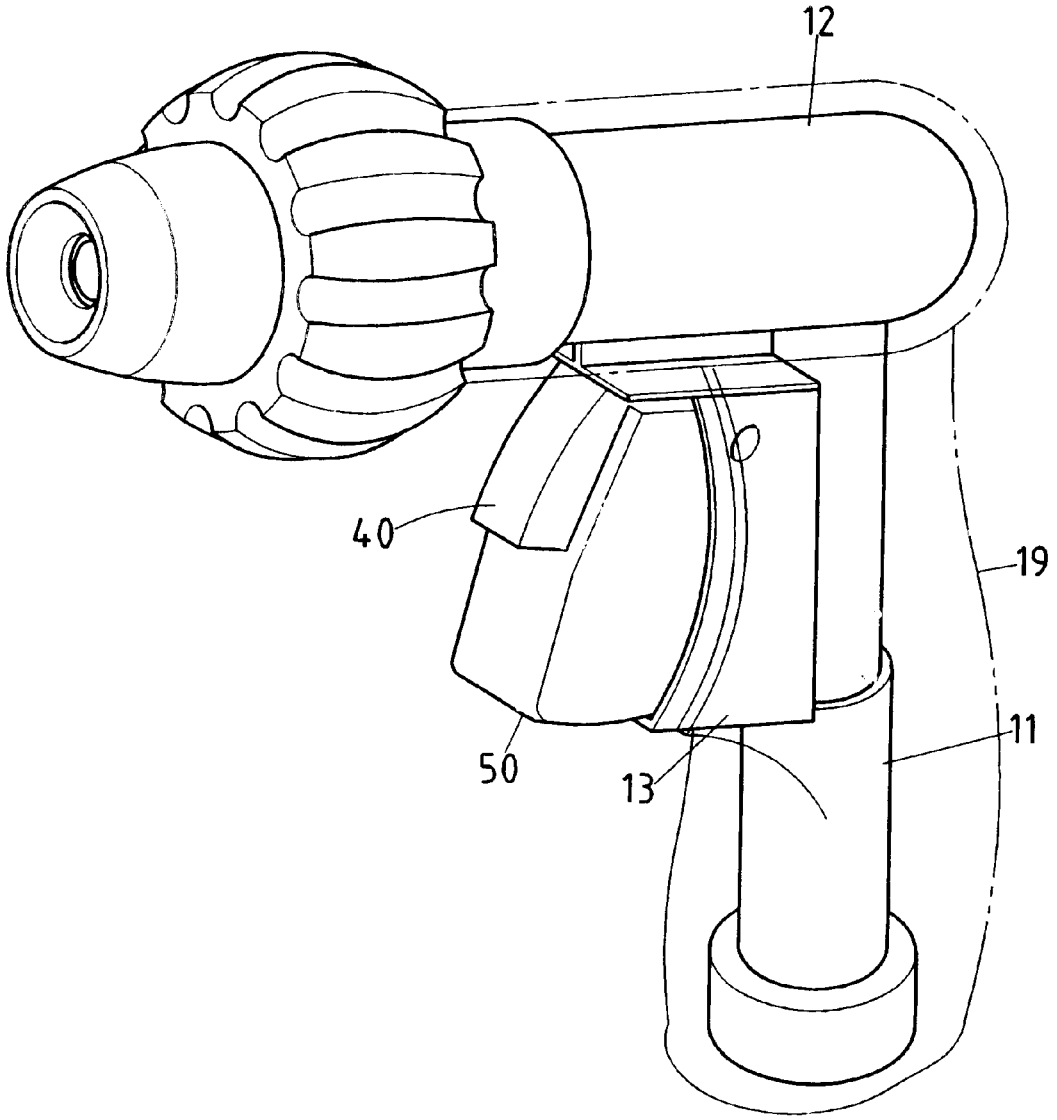
FIG. 1 shows a perspective view of a water sprayer nozzle of the preferred embodiment of the present invention.
Figure 2:
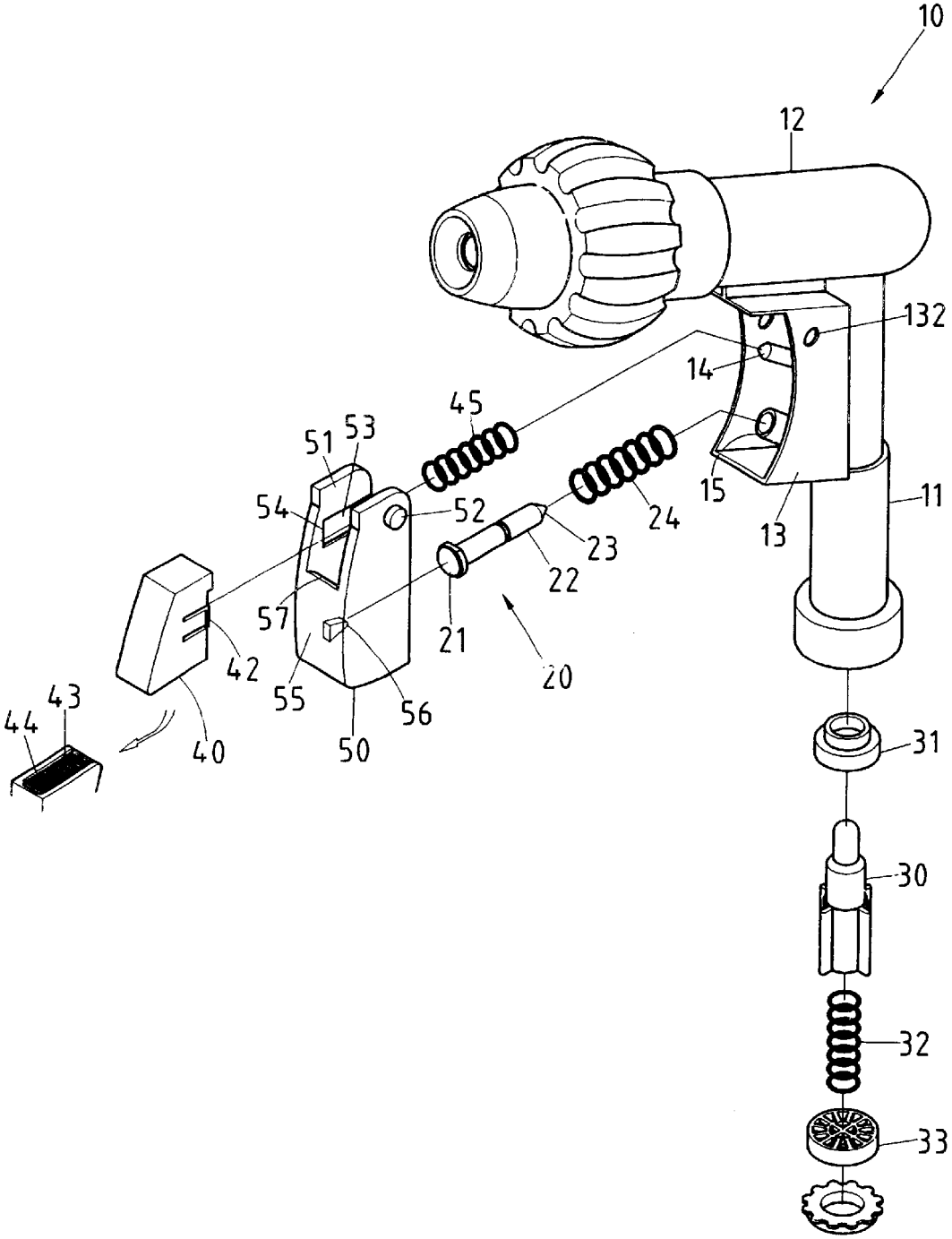
FIG. 2 shows a partial exploded view of the present invention.
Figure 3:
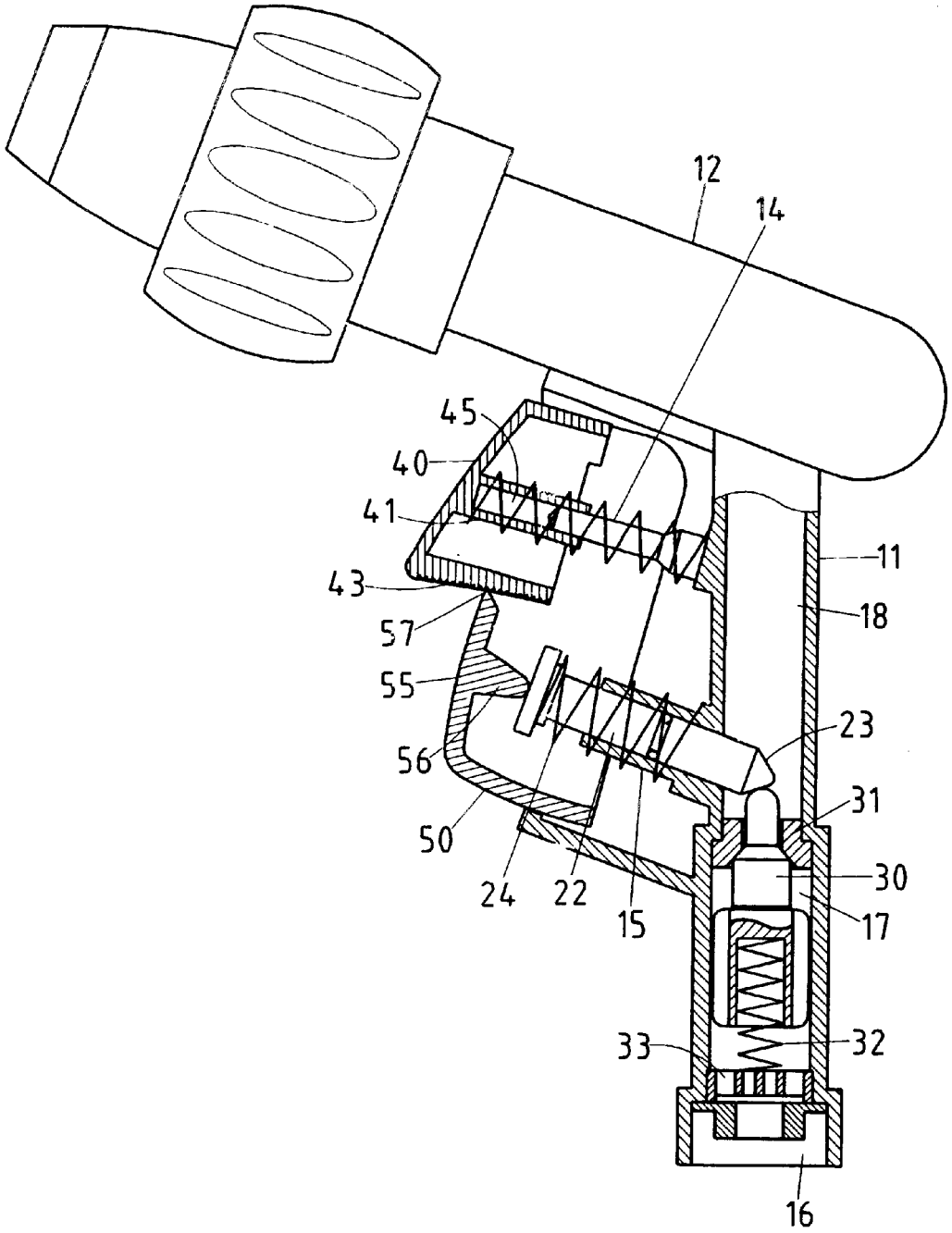
FIG. 3 shows a partial sectional view of the present invention.
Figure 4:
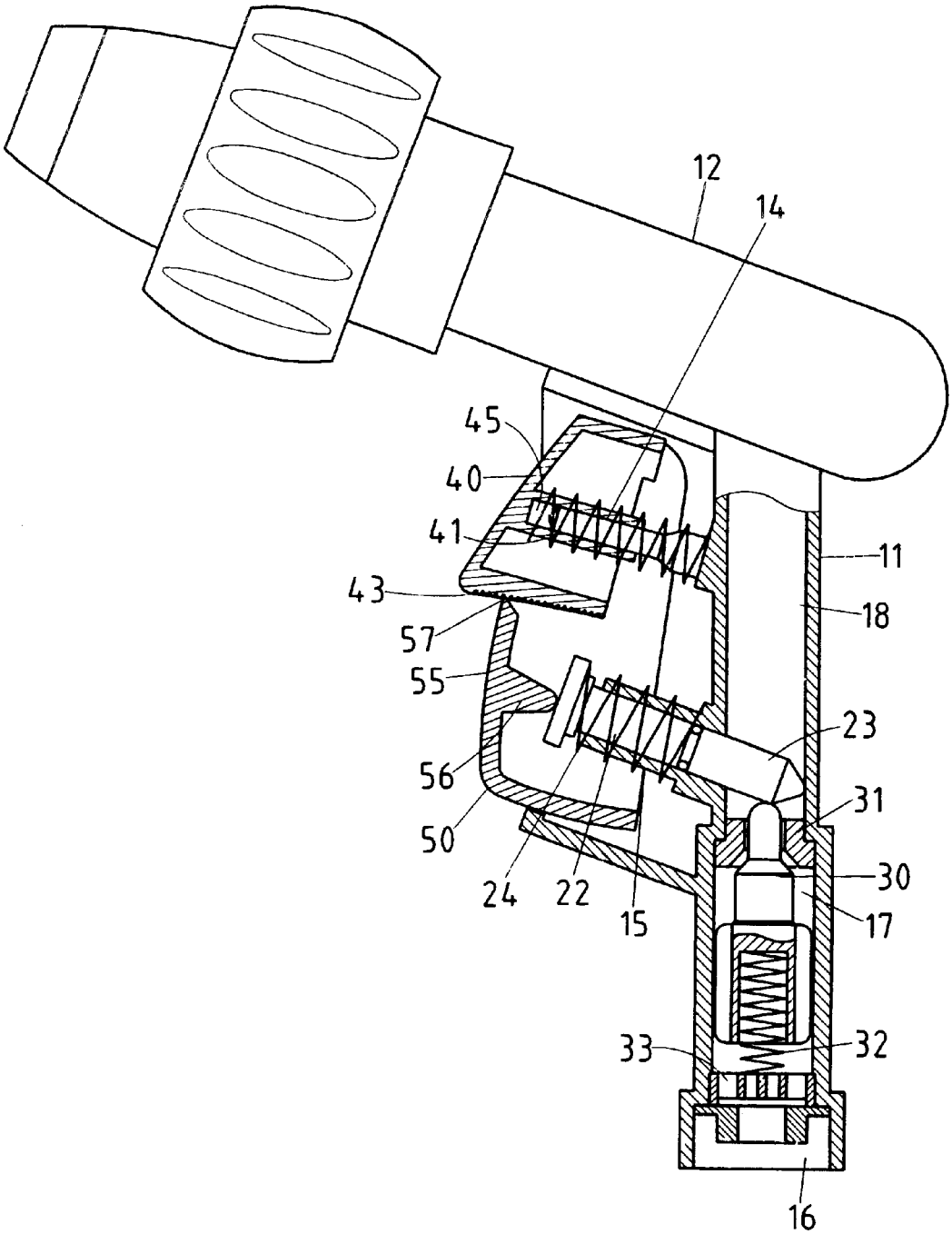
FIG. 4 shows another partial sectional view of the present invention.
Figure 5:
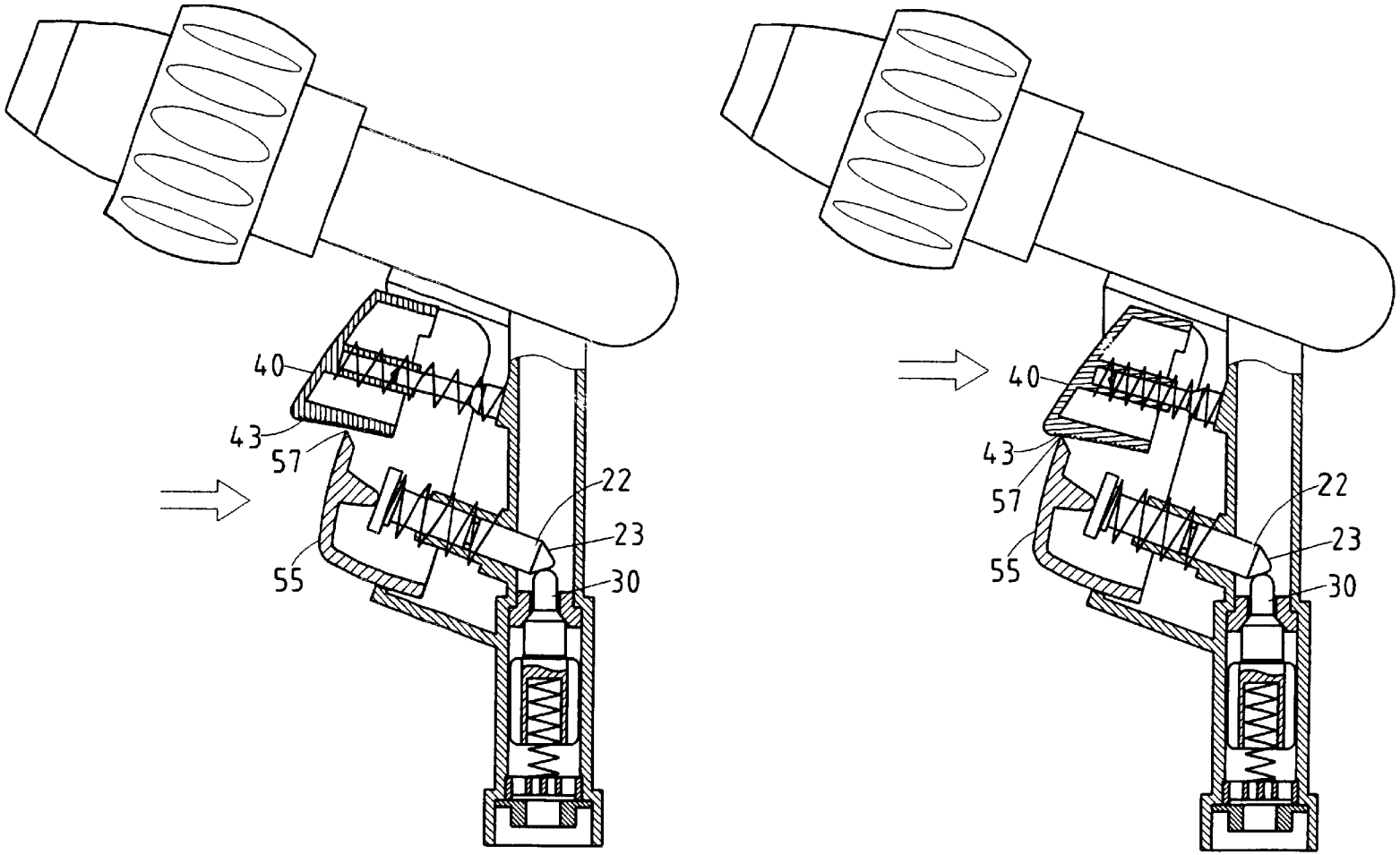
FIG. 5 shows a sectional schematic view of the present invention in operation.

As shown in FIGS. 1, 2, and 3, a water sprayer nozzle 10 embodied in the present invention comprises a hand grip 11, a barrel 12, a push rod member 20, a water stopping member 30, an orientation push button 40, and a control push button 50.

The hand grip 11 is hollow and in communication with the barrel 12. The hand grip 11 is provided with a receiving member 13 having a retaining rod 14 and a hollow tubular body 15 in communication with the hand grip 11. The hand grip 11 is provided at the free end thereof with a hose connector 16, in the lower segment thereof with a receiving compartment 17, and in the upper segment thereof with a water channel 18 in communication with the receiving compartment 17 and the interior of the barrel 12.

The push rod member 20 comprises a head 21, a shank 22, a tapered end 23, and a spring 24 fitted over the shank 22. The push rod member 20 is received in the hollow interior of the tubular body 15.

The water stopping member 30 is received in the receiving compartment 17 of the hand grip 11 and is provided at the top end thereof with a washer 31 which is located at the juncture of the receiving compartment 17 and the water channel 18. The bottom end of the water stopping member 30 is biased by one end of a spring 32. Located at the juncture of the receiving compartment 17 and the hose connector 16 is a locating piece 33 in contact with the other end of the spring 32.

The orientation push button 40 is provided with a retaining tube 41 which is fitted over the retaining rod 14 of the receiving member 13. The orientation push button 40 is provided on both sides of one end thereof with a retaining piece 42, and in the underside thereof with a ribbed plate 43 having two guide holes 44. The retaining tube 41 is fitted into a spring 45.

The control push button 50 is provided at the top thereof with two plate bodies 51 opposite to each other and having in the inner side wall thereof with a guide slot 53 provided at one end thereof with a stop edge 54. The control push button 50 is further provided with a stop column 56 and a retaining edge 57. The control push button 50 is received in a receiving space of the receiving member 13 such that the orientation push button 40 is received between the two plate bodies 51, and that two protrusions 52 of the control push button 50 are retained by two retaining holes 132 of the receiving member 13, and further that the retaining pieces 42 of the orientation push button 40 are received in the two guide slots 53 of the control push button 50, and further that the retaining edge 57 is engaged with the ribbed plate 43 of the orientation push button 40, and further that the stop column 56 is in contact with the head 21 of the push rod 20.

As long as the orientation push button 40 and the control push button 50 are not pushed, the water sprayer nozzle 10 of the present invention does not shoot out water. When both the orientation push button 40 and the control push button 50 are pushed at the same time in the direction toward the receiving member 13, a large flow of water is discharged by the water sprayer nozzle 10 in view of the fact that the retaining edge 57 of the control push button 50 is engaged with the ribbed plate 43 of the orientation push button 40, and that the water stopping member 30 is pushed downward by the tapered end 23 of the push rod member 20, thereby resulting in the formation of a great gap between the washer 31 and the water channel 18. The size of the gap between the washer 31 and the water channel 18 can be adjusted by the control push button 50. Depending on the extent to which the control push button 50 is pushed, the water flow of the water channel 18 can be adjusted.

As shown in FIG. 1, the hand grip 11 of the water sprayer nozzle 10 of the present invention is provided with a rubber jacket 19 fitted thereover.

What is claimed is:

1. A water sprayer nozzle apparatus comprising:

a barrel;

a hand grip affixed at one end to said barrel, said hand grip having a hose connector at an opposite end, said hand grip having an interior channel in communication with an interior of said barrel, said hand grip having a receiving compartment formed therein and in communication with said interior channel;

a stopping member received in said receiving compartment, said stopping member having a washer affixed at one end thereof, said stopping member having a spring biasing an opposite end thereof, said washer positioned at a juncture of said interior channel and said receiving compartment;

a receiving member affixed to said hand grip, said receiving member having a retaining rod therein, said receiving member having a hollow tubular body in communication with said interior channel, said receiving member having a pair of retaining holes;

a push rod member engageable with said stopping member so as to form a gap between said interior channel and a wall of said receiving compartment, said push rod member being fitted into said hollow tubular body such that one end of said push rod member can contact said one end of said stopping member;

a control push button having a pair of plate bodies facing and spaced from each other, said control push button having a retaining edge, said control push button having a pair of protrusions and a stop column, said control push button being fastened to said receiving member such that said pair of protrusions of said control push button are retained respectively by said two retaining holes of said receiving member, said stop column being in contact with said opposite end of said push rod member, said pair of plate bodies of said control push button having respective guide slots formed in an inner side wall thereof; and an orientation push button having a retaining tube, said orientation push button having a ribbed plate, said orientation push button being received between said pair of plate bodies of said control push button such that said retaining tube is fitted over said retaining rod of said receiving member, said retaining tube having a spring fitted thereover, said orientation push button having two retaining pieces which are located in said guide slots of said control push button, said push rod member having a spring fitted thereover, the retaining edge of the control push button being engageable with the ribbed plate of the orientation push button to regulate the gap between said interior channel and the wall of said receiving compartment.

* * * * *